United States Patent [19]

Hoppe et al.

[11] 4,298,158

[45] Nov. 3, 1981

[54] PACKAGING ELEMENT FOR PACKAGING SHEET MATERIAL

[75] Inventors: Joachim Hoppe; Yahya Haghiri-Tehrani, both of Munich, Fed. Rep. of Germany

[73] Assignee: GAO Gesellschaft für Automation und Organisation mbH, Munich, Fed. Rep. of Germany

[21] Appl. No.: 129,567

[22] Filed: Mar. 12, 1980

[30] Foreign Application Priority Data

Mar. 13, 1979 [DE] Fed. Rep. of Germany ..... 2909834

[51] Int. Cl.[3] ..... B65D 27/10

[52] U.S. Cl. ..... 229/69; 206/820; 206/526; 206/390; 221/73

[58] Field of Search ..... 229/69; 206/820, 390, 206/526, 330, 461, 525; 221/70–74

[56] References Cited

U.S. PATENT DOCUMENTS 3,987,931 10/1976 Fell et al. ..... 229/69 X 4,214,388 7/1980 Dickey ..... 229/69 X

*Primary Examiner*—George T. Hall

*Attorney, Agent, or Firm*—Andrus, Sceales, Starke & Sawall

[57] ABSTRACT

A banknote packaging element, process, and separating apparatus utilize a plurality of envelopes for receiving sheet material. The envelopes are arranged in succession and have their undersides separately attached to an auxiliary belt. The auxiliary belt is formed of a continuous tear-off strip formed as an integral part of the envelope and adapted to be separated along perforated lines.

9 Claims, 4 Drawing Figures

PACKAGING ELEMENT FOR PACKAGING SHEET MATERIAL

BACKGROUND OF THE INVENTION

This invention relates to a packaging element for packaging sheet material such as banknotes, consisting of a plurality of envelopes for receiving the sheet material, said envelopes being arranged in succession and having their undersides separably attached to an auxiliary belt between the leading edge and the center of gravity. This invention also relates to a process for producing and an apparatus for separating such packaging elements.

Automatic money dispensers have recently been developed which dispense a specific number of banknotes when operated by an appropriately authorized person. In the known automatic money dispensers, a differentiation is made between dispensing individual bills and dispensing packets of bills. Owing to the simplified separation and the reduced risk of incorrect or malseparations (double bills), it has proved to be advantageous to package the banknotes in plastic envelopes and to dispense them from the automatic money dispensers in this form. Although the money is limited to predetermined, fixed amounts, this does not prove to be a disadvantage in practice. Only one separation operation is required for each money dispensing operation. By virtue of the packagings provided for this purpose, this separation operation is especially simple and reliable to execute.

Dispensing packets of money thus not only increases the reliability of separation, but also makes it possible to simplify the separating apparatus and the association monitoring elements.

German laying-open print DE-AS No. 2,419,737 recites and illustrates a separating apparatus which is capable of dispensing individual packaging elements in succession such as plastic envelopes accommodating cards or banknotes, for example. The plastic envelopes are attached to an auxiliary belt with equidistant spacing in an imbricated arrangement in a progressive sequence. The envelopes are affixed by two proximate welding spots in each case.

The envelopes are stacked one above the other in such a way that the auxiliary belt engages the leading edges similar to a bellows so that in each case a bending site is positioned adjacent to the leading edge of the envelope, adjacent to which the belt is fused to the underside of each envelope, whilst a second bending site is located between this envelope and the next envelope above it. By drawing the auxiliary belt over a lateral outlet opening, the individual plastic envelopes are removed from the stack in succession and are pulled along. In a downstream transport path, the belt is rotated by about 180° whilst the envelope continues on without changing its direction. This causes the auxiliary belt to be torn off the underside of the envelope. The envelope can then be removed from the device and the detached belt is wound up on a roll.

The production of the known packaging element is a labour-intensive, since the actual envelopes have to be fused additionally to an auxiliary belt. Owing to the imbricated arrangement of the envelopes on the auxiliary belt, subsequent filling of the packages is troublesome, since the envelopes obstruct one another. In particular owing to the somewhat troublesome filling of the envelopes, the production of the filled envelopes is meaningful preferably at their place of manufacture, i.e. central production. "Decentral" filling of the packagings, i.e. in those banks in which the automatic money dispensers are located, however is also desirable for a more flexible handling of the money dispensing systems as well as for their utilization in other general fields of application.

Another drawback of the known packaging elements is seen in the fact that the force required to tear the auxiliary belt from the envelopes is relatively high compared to the force which is required to pull the packaging element into its position of separation. What is desirable, by contrast, would be for the force of separation of the auxiliary belt from the envelope during separation in the direction of transport to be as high as possible and the force of separation of the auxiliary belt perpendicular to the direction of transport to be low so that, on the one hand, the envelopes could reliably be brought into their separation position and, on the other hand, the auxiliary belt can be torn off the envelopes without difficulty and without deforming the envelopes.

SUMMARY OF THE INVENTION

The object of the invention is to provide a packaging element which in light of its use as a mass-produced article is as simple as possible in manufacture, which facilitates reliable separation and which can be filled equally well during any phase of production.

This object is accomplished in accordance with the invention in that the auxiliary belt is formed of at least one continuous tear-off strip which is an integral part of the envelopes and is adapted to be separated therefrom by perforated lines. This obviates a separate tear-off strip, thus reducing the price of the packaging element. The individual envelopes are situated one behind the other without mutually impeding each other and can therefore readily be filled even after the manufacturing process has been completed.

The individual envelopes are advantageously stacked one above the other with the same orientation and the tear-off strip(s) of each envelope is(are) separated from the underside beginning at the trailing edge and extending approximately to the middle. The envelopes are thus slid over one another in an imbricated arrangement so that the leading edge of one is above the leading edge of the other. In so doing, one portion of the perforated line is torn, which is tantamount to a performnce check of the respective envelope, so that during subsequent separation and final separation of the tear-off strip, it can be assumed or taken for granted that the tear-off strip lends itself to complete separation during the separation operation without any difficulty.

The attachment of the tear-off strip to one side of the envelope by means of a perforated line is also advantageous because the forces required to tear the strip off the envelope in the direction of transport are substantially greater than perpendicular thereto. The tear-off forces can also be adjusted optimally as a function of the tear strength of the plastic sheet by appropriately designing the width of the non-perforated segments of the perforated line.

The packaging element is manufactured in accordance with the invention in that an endless sheet with perforated lines is deposited or placed on a substrate, in particular a sheet having approximately the width of the envelopes. The substrate and sheet are subsequently fused together at the edges in the planned format of the envelopes, said tear-off strip, however, not being fused together. The envelopes are then separated from one another in the area of the transversely extending welding seams, all except of the tear-off strip. In the event that the substrate beneath the tear-off strip was not initially cut and is still not cut, this strip alone is now punched along the extension of the transversely extending welding seams. If the envelope has not yet been filed, it is now filled through a longitudinally extending seam which has not yet been fused. This seam is then fused subsequently thereto.

This method of production is especially rational, since the individual envelopes do not have to be positioned separately nor do they have to be fused to a separate auxiliary belt.

The packaging element which is telescoped together in an imbricated manner to form a parallel stack can be separated in accordance with the invention in an apparatus in which the envelopes are pulled by their tear-off strips in succession out of a stack container and then conveyed into a transport path. In this transport path, the tear-off strip is bent downwardly and then torn off approximately perpendicular to the direction in which the envelopes are transported, while the envelopes themselves continue on in the same direction being conveyed over baffles. This utilizes an advantage of the packaging element, viz. that the forces required to separate the tear-off strip in the direction of transport are substantially higher than perpendicular thereto.

Other constructions and designs of the invention are the subject matter of the subclaims.

BRIEF DESCRIPTION OF THE DRAWING

An embodiment of the invention will now be described in the following by way of example with reference to the enclosed drawing, in which.

DESCRIPTION OF THE PREFERRED EMBODIMENT

Figure 1:
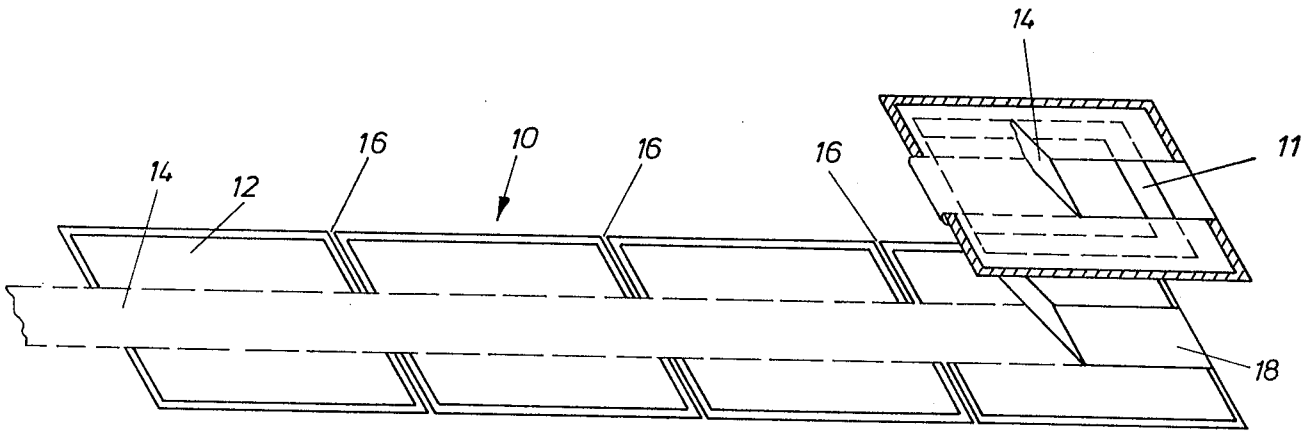
FIG. 1 is the packaging element after fusion of the individual envelopes, one envelope already being located above another envelope to fill a parallel stack with partial separation of the tear-off strip.

FIG. 1 illustrates a packaging element 10 consisting of individual discrete envelopes 12. The discrete envelopes 12 consist of a substrate sheet and a cover sheet, each of a transparent plastic, preferably polyethylene. The cover sheet includes a perforated tear-off strip 14 which extends continuously and is positioned symmetrically to the center line. The substrate and cover sheets are fused together along their edges, although the area covered by the tear-off strip 14 is not fused together. The envelopes are cut apart up to the junction of the tear-off strip 14 in the vicinity of the transversely extending welding seams 16. The substrate sheet, which is on the bottom in FIG. 1, is also cut through beneath the tear-off strip 14 so that the individual envelopes 12 are interconnected solely by means of the continuous tear-off strip 14.

The cut in the substrate sheet beneath the tear-off strip 14 in the vicinity of the transversely extending welding seams 16 is preferably effected before the substrate and cover sheets are joined. After they are fused together, the only operation still remaining is merely to cut the welding seam 16 on both sides from the edge up to the junction of the tear-off strip 14. It is also possible, of course, to effect this cut at some later time using a knife which is pressed against the welding seam 16 from below and which co-acts with an appropriately shaped abutment.

The envelopes 12 can be filled either prior to fusion, although it is also possible to leave the welding seams extending along the sides unfused and to fill the envelope at some later time. The welding seam, which is initially left unfused, must subsequently be fused together after the envelopes 12 have been filled. Such fusion apparatuses for welding and fusing plastic sheets are known in the art and are available commercially so that the envelopes can also be fused together without any problems decentrally, i.e. at each and every bank.

The right side of FIG. 1 shows how the individual envelopes can be combined to form a stack. The envelope which is at the right in each case is slid parallel onto the envelope which lies to the left thereof. This is possible, since the individual envelopes are joined solely by the tear-off strip 14. As the envelopes are slide over one another, the tear-off strip 14 is separated approximately half way through the cover sheet 12. This is advantageous, since this makes it possible to check the perforation to see that it is functioning properly, viz. such that the strip is separated from the envelope. The banknotes 11 already inside the envelopes 12 cannot fall out through the narrow, open gap 18.

Figure 2:
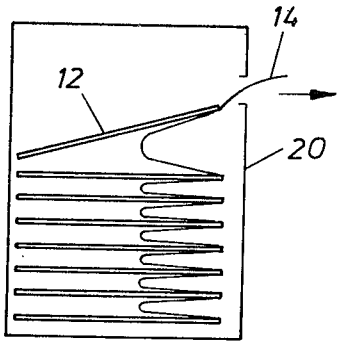
FIG. 2 is the packaging element as a parallel stack as can be placed into the separation container in appropriate apparatuses.

By continuously sliding one envelope over the next one, a stack will be formed as is shown in FIG. 2. For the sake of clarity, the individual envelopes 12 in the stacked arrangement have been depicted in an exaggerated separated condition.

The stack is disposed in a vertical container 20 in such a manner that the tear-off strip 14 is folded about the leading edges of the envelopes 12 in a fashion similar to a bellows. In the area extending from the leading edge of the envelope up to the middle of each underside of an envelope 12, the perforation is still intact so that the tear-off strip 14 in this area is still integrally attached to the underside of the envelope. In the rear half of the underside as seen in the arrangement shown in FIG. 2, there is located the open slot 18. Between two successive envelopes 12, the tear-off strip 14 again returns to the leading edge of the next lowermost envelope 12.

The arrangement, of course, can also be reversed, the envelopes 12 then being pulled out laterally from the bottom of the stack. In this case, the open slot 18 faces upwardly.

Figure 3:
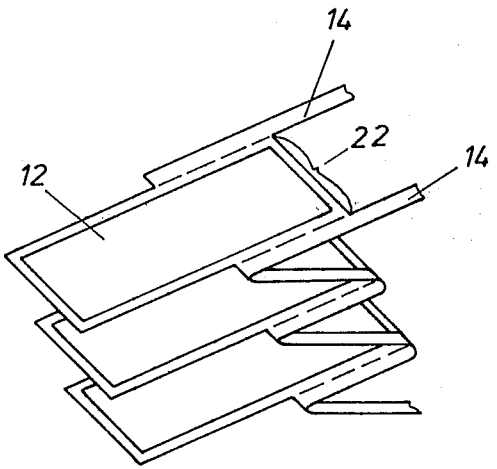
FIG. 3 is another embodiment of the arrangement of the tear-off strip.

Another embodiment of the envelopes 12 is shown in FIG. 3 in which the envelope 12 remains completely closed even after removal of the tear-off strip 14. The tear-off strip 14 according to FIG. 1, which extends along the middle of the cover sheet, has been replaced by two tear-off strips 14 in the embodiment shown in FIG. 3, each of which is disposed externally on the edge and each of which is adapted to be separated from the envelopes 12 by means of a perforated line. After the successively arranged envelopes 12 have been fused, the only step required in this embodiment is merely to cut the length 22 between the two tear-off strips 14. This cutting operation can be effected quite simply by a suitably designed knife punch. The envelopes 12 are stacked according to the same principle as was employed for the envelope according to FIG. 1, with the sole difference that the envelopes 12 are joined to two parallel tear-off strips 14 in each case instead of to only one strip.

Figure 4:
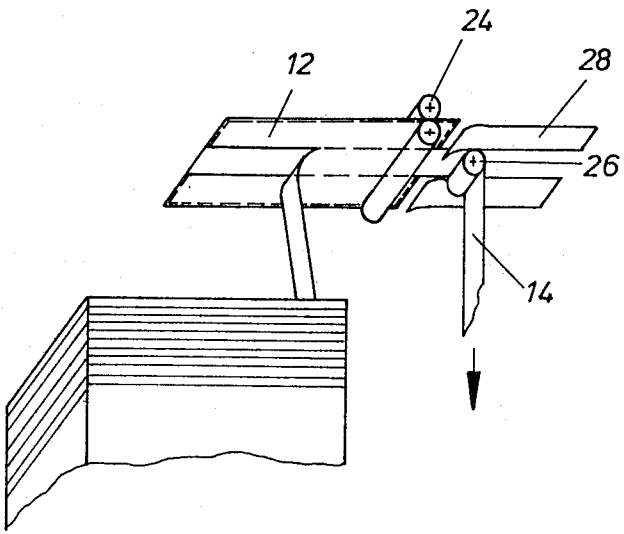
FIG. 4 is the packaging element as a parallel stack illustrating the functional association to the most important parts of an apparatus for separating envelopes.

FIG. 4 shows a stack of envelopes which have the design already illustrated in FIG. 1. The uppermost envelope in the stack is pulled by the tear-off strip 14 into the nip between two transport rollers 24. The tear-off strip 14 moves past transport rollers 24 and is then diverted 90° in a downwardly direction by guide roller 26, while the envelope 12 continues to move in a straight line over baffles 28. Owing to the perpendicular downward tension, the tear-off strip 14 is separated along the perforated lines without difficulty.

The envelope 12 can then be transported further to a discharge slot, as the case may be. The strip 14 is wound up separately and, as a consequence of doing so, pulls the next envelope off the stack and into the nip between the transport rollers 24. The important aspect of the separating apparatus is the fact that the tear-off strip 14 is separated almost perpendicularly to the direction of transport of the envelope 12. This measure is accompanied by the advantage that all non-perforated segments of the still intact perforation bear the burden in the transport direction, i.e. the force required to tear off the strip in the transport direction is very high, while the force required to tear off the strip perpendicularly thereto is determine by the width of each and every non-perforated segment, thus being much less.

The envelopes in accordance with the embodiment shown in FIG. 3 can be separated in a similar manner. Two guide rollers 26 disposed laterally of the envelope 12 must needs be provided in this case.

What is claimed is:

1. The packaging element for packaging sheet material such as banknotes, consisting of a plurality of envelopes for receiving the sheet material, said envelopes being arranged in succession and having their undersides separably attached to an auxiliary belt between the leading edge and the center of gravity, characterized in that the auxiliary belt is formed of at least one continuous tear-off strip (14) which is an integral part of the envelopes (12) and is adapted to be separated therefrom by perforated lines.

2. A packaging element according to claim 1, wherein the perforated tear-off strip (14) extends symmetrically to the common center line of the envelopes which are disposed successively edge to edge.

3. A packaging element according to claim 1, wherein a tear-off strip (14) extends on both sides of the common center line of the envelopes (12) which are disposed successively edge to edge.

4. A packaging element according to claim 3, wherein the tear-off strip (14) is formed by the outer marginal edges of the envelopes (12).

5. A packaging element according to claim 1, wherein the individual envelopes (12) are stacked with the same orientation one above the other and the tear-off strip(s) (14) of each envelope (12) is(are) separated from the underside beginning at the trailing edge and extending approximately to the middle.

6. A process for producing a packaging element for sheet material such as banknotes, consisting of a plurality of envelopes for receiving said sheet material, said envelopes being arranged in succession and having their undersides separably attached to an auxiliary belt between the leading edge and the center of gravity, characterized by the following steps:

(a) an endless sheet with perforation lines is deposited on a substrate, in particular a sheet having approximately the width of the envelopes, (b) the substrate and sheet are fused together at the edges in the planned format of the envelopes, said tear-off strip, however, not being fused together, (c) the envelopes are separated from one another in the area of the transversely extending welding seams, said tear-off strip, however, not being torn, (d) the substrate is additionally separated, if desired, in the extension of the transversely extending welding seams, (e) the envelope, if desired, is filled through a longitudinally extending seam which has not yet been fused, but which is then fused subsequently thereto.

7. A process according to claim 6, wherein the forces required to separate the tear-off strip from the envelope are determined by the width of the non-perforated segments of said perforation line.

8. A process according to claim 7, wherein the individual envelopes are slid over one another with imbrication to form a stack, one part of the tear-off strip being separated from the underside of the envelope.

9. An apparatus for separating envelopes stacked one above the other whose leading edges are engaged by a strip which is folded in a bellows-like manner and which is affixed to each of the envelopes on the underside thereof, characterized in that the envelopes (12) are interconnected by a strip (14) which is integrally attached to the leading area of the underside of each envelope (12) and which is adapted to be separated therefrom along the perforation lines, said envelopes being pulled in succession out of a stack container (20) into a transport path in which the strip (14) is bent downwardly and then pulled off approximately perpendicular to the direction of transport of said envelopes (12) whilst the envelopes (12) are conducted over baffles (28) and continue on in the same direction.

* * * * *